US008438768B2

(12) United States Patent
Kallio

(10) Patent No.: US 8,438,768 B2
(45) Date of Patent: May 14, 2013

(54) MAGAZINE DISCONNECT MECHANISM FOR FIREARM

(75) Inventor: Robert A. Kallio, Conesus, NY (US)

(73) Assignee: Sturm, Ruger & Company, Inc.

( * ) Notice: Subject to any disclaimer, the term of this patent is extended or adjusted under 35 U.S.C. 154(b) by 153 days.

(21) Appl. No.: 12/986,272

(22) Filed: Jan. 7, 2011

(65) Prior Publication Data

US 2012/0174453 A1 Jul. 12, 2012

(51) Int. Cl.
*F41A 17/36* (2006.01)

(52) U.S. Cl.
USPC ..... 42/70.02

(58) Field of Classification Search ..... 42/70.02, 42/70.01
See application file for complete search history.

(56) References Cited

U.S. PATENT DOCUMENTS

| | | | | |
|---|---|---|---|---|
| 1,866,202 | A * | 7/1932 | Floyd | 89/137 |
| 2,372,519 | A | 3/1945 | Roper | |
| 3,415,000 | A * | 12/1968 | Koucky et al. | 42/70.02 |
| 3,715,826 | A | 2/1973 | Seifred et al. | |
| 3,964,200 | A | 6/1976 | Patterson | |
| 4,016,669 | A | 4/1977 | Gminder | |
| 4,021,955 | A | 5/1977 | Curtis | |
| 4,031,648 | A * | 6/1977 | Thomas | 42/70.02 |
| 4,291,481 | A | 9/1981 | Hillberg | |
| 4,420,899 | A | 12/1983 | Bourlet et al. | |
| 4,522,105 | A | 6/1985 | Atchisson | |
| 4,765,224 | A | 8/1988 | Morris | |
| 5,038,666 | A | 8/1991 | Major | |
| 5,086,579 | A | 2/1992 | Flatley et al. | |
| 5,179,233 | A | 1/1993 | duPlessis | |
| 5,225,612 | A | 7/1993 | Bernkrant | |
| 5,426,880 | A | 6/1995 | Ruger et al. | |
| 5,438,784 | A | 8/1995 | Lenkarski et al. | |
| 5,669,169 | A | 9/1997 | Schmitter et al. | |
| 5,697,178 | A | 12/1997 | Haskell | |
| 5,701,698 | A | 12/1997 | Wesp et al. | |
| 5,899,013 | A | 5/1999 | Hauser et al. | |
| 5,974,717 | A | 11/1999 | Brooks | |
| 6,240,669 | B1 | 6/2001 | Spaniel et al. | |
| 6,256,918 | B1 | 7/2001 | Szabo | |

(Continued)

FOREIGN PATENT DOCUMENTS

| | | |
|---|---|---|
| DE | 4009372 | 4/1989 |
| DE | 19507012 | 9/1996 |

(Continued)

OTHER PUBLICATIONS

Corresponding PCT/US 12/20294 Search Report and Written Opinion dated May 1, 2012.

*Primary Examiner* — Bret Hayes
(74) *Attorney, Agent, or Firm* — The Belles Group, P.C.

(57) ABSTRACT

A auto-loading firearm with magazine disconnect mechanism operable to disable the firing control mechanism of the firearm. The firearm may include a frame, a magazine adapted for holding a plurality of cartridges, and a pivotably mounted trigger movable for discharging the firearm. A magazine disconnect member is provided that is selectively engageable with the trigger and movable in response to removing and inserting the magazine. In one embodiment, the disconnect member may be slidably disposed in the frame proximate the trigger. In one position, the disconnect member engages the trigger when pulled to block or restrict movement of the trigger and disable the firing control mechanism to prevent discharging the firearm. A spring biases the disconnect member towards engagement with the trigger.

21 Claims, 10 Drawing Sheets

U.S. PATENT DOCUMENTS

| | | | |
|---|---|---|---|
| 6,308,449 | B1 | 10/2001 | Plebani |
| 6,405,631 | B1 | 6/2002 | Milek |
| 6,412,207 | B1 | 7/2002 | Crye et al. |
| 6,415,702 | B1 | 7/2002 | Szabo et al. |
| 6,457,271 | B1 | 10/2002 | Vaid et al. |
| 6,519,887 | B1 | 2/2003 | Allen et al. |
| 6,560,909 | B2 | 5/2003 | Cominolli |
| 6,588,136 | B2 | 7/2003 | Baker et al. |
| 6,615,527 | B1 | 9/2003 | Martin |
| 6,640,478 | B2 | 11/2003 | Johansson |
| 6,655,066 | B2 | 12/2003 | Fluhr |
| 6,665,973 | B1 | 12/2003 | Peev |
| 6,769,208 | B2 | 8/2004 | Beretta |
| 6,952,895 | B1 | 10/2005 | Zonshine |
| 7,096,618 | B2 | 8/2006 | McGarry |
| 7,204,051 | B2 | 4/2007 | Thomele et al. |
| 7,257,918 | B2 | 8/2007 | Moore |
| 7,293,385 | B2 | 11/2007 | McCormick |
| 7,360,331 | B2 | 4/2008 | McGarry |
| 7,392,611 | B2 | 7/2008 | Curry |
| 7,472,507 | B2 | 1/2009 | Curry et al. |
| 7,500,327 | B2 | 3/2009 | Bubits |
| 7,526,889 | B2 | 5/2009 | Metzger et al. |
| 7,568,302 | B1 | 8/2009 | Bubits |
| 7,581,345 | B2 | 9/2009 | McGarry |
| 7,690,144 | B2 | 4/2010 | Fagundes de Campos |
| 7,698,845 | B2 | 4/2010 | Hochstrate et al. |
| 7,703,230 | B2 | 4/2010 | Curry et al. |
| 2002/0152660 | A1 | 10/2002 | Fluhr |
| 2003/0070342 | A1 | 4/2003 | Baker et al. |
| 2005/0108914 | A1 | 5/2005 | Thomele |
| 2005/0241204 | A1 | 11/2005 | Hajjar et al. |
| 2005/0246933 | A1* | 11/2005 | McGarry ..... 42/70.02 |
| 2008/0148618 | A1 | 6/2008 | McGarry |

FOREIGN PATENT DOCUMENTS

| | | |
|---|---|---|
| EP | 0428292 | 5/1991 |
| EP | 0907065 | 4/1999 |
| GB | 191104607 | 3/1911 |
| WO | WO 0159387 | 8/2001 |

* cited by examiner

MAGAZINE DISCONNECT MECHANISM FOR FIREARM

BACKGROUND OF THE INVENTION

The present invention generally relates to firearms, and more particularly to magazine disconnect mechanisms suitable for auto-loading pistols of a compact size.

Compact firearms, such as semiautomatic auto-loading pistols for concealed carry applications, present numerous design challenges due to the need to provide essentially the same functionality as full-size pistols, but in a relatively smaller physical package. Some compact pistols may have typical lengths between about 5-6 inches and weigh less than one pound in contrast to their longer and heavier full-size counterparts. Accordingly, it is desirable to minimize size and weight of these subcompact pistols to facilitate concealed carry by keeping the number of components required for a fully-functional pistol to a minimum without sacrificing functionality. Therefore, efficient use of limited available space which is at a premium is essential to providing lightweight and compact pistols suitable for concealed carry.

Most auto-loading pistols utilize removable magazines that hold a plurality of cartridges. In such pistols, a cartridge may still remain chambered after the magazine has been removed. Although the loaded chamber condition of a pistol's chamber is customarily and most positively checked by user opening the action to expose the breech area and visually observing the presence of any cartridge therein, a magazine disconnect mechanism operable to disable the firing control mechanism when the magazine is removed from the pistol may sometimes be provided to supplement, but not replace visual inspection of the chamber.

A magazine disconnect mechanism is desired that can be spatially and efficiently accommodated in the limited space available in a compact pistol format.

SUMMARY OF THE INVENTION

According to one aspect of the invention, an auto-loading firearm with removable magazine is provided that includes a magazine disconnect mechanism which disables the firing control mechanism when the magazine is removed to prevent discharging the firearm under normal trigger pull pressure. In some preferred embodiments, the disconnect mechanism directly engages and disables the trigger by restricting or arresting the movement of the trigger when pulled by a user to prevent so that the trigger cannot be rotated a sufficient amount to fully actuate the firing control mechanism. To efficiently use the limited space available in compact pistol format, the magazine disconnect member in preferred embodiments is slidably disposed in the firearm and axially movable in response to the insertion and removal of the magazine into/from the firearm via contact with the magazine. In some embodiments, as further described herein, the magazine disconnect member may be configured as a generally flat or planar slideable plate.

According to one exemplary embodiment of the present invention, an auto-loading firearm with magazine disconnect mechanism includes a frame defining a longitudinal axis, a magazine removably disposed in the frame for holding a plurality of cartridges, a hammer pivotably mounted in the frame, a trigger pivotably movable in the frame and operable to cock and release the hammer for discharging the firearm, and a magazine disconnect member selectively engageable with the trigger in response to removing and inserting the magazine from/into the firearm. In one embodiment, the magazine disconnect member may be configured as a generally flattened plate slidably movable within the housing into and out of engagement with the trigger. In response to inserting and removing the magazine, the magazine disconnect member is movable between a blocking position in which the disconnect member engages the trigger when pulled and a non-blocking position in which the disconnect member does not engage the trigger when pulled. The firearm further includes a biasing member urging the magazine disconnect member into the blocking position. The magazine disconnect member is operable such that inserting the magazine into the frame moves the magazine disconnect member from the blocking position to the non-blocking position, and removing the magazine from the frame moves the disconnect member from the non-blocking position to the blocking position in which movement of the trigger is restricted to prevent cocking the hammer. The firing control mechanism of the firearm is therefore disabled and the firearm is prevented from being discharged without the magazine fully inserted into the firearm. In some embodiments, the firearm may be a compact auto-loading pistol. In other embodiments, the firearm may be a full-size auto-loading pistol or rifle.

According to another exemplary embodiment of the present invention, an auto-loading firearm with magazine disconnect mechanism includes a frame defining a longitudinal axis, a magazine removably disposed in the frame for holding a plurality of cartridges, a hammer pivotably mounted in the frame, a trigger pivotably movable in the frame and operable to cock and release the hammer for discharging the firearm wherein the trigger further includes a front portion that defines a first blocking surface, and a magazine disconnect member defining a second blocking surface which is selectively engageable with the first blocking surface of the trigger. The magazine disconnect member is longitudinally movable in response to removing and inserting the magazine between (i) a blocking position in which the second blocking surface is positioned to engage the first blocking surface of the trigger when pulled to prevent cocking the hammer and (ii) a non-blocking position in which the second blocking surface is positioned to not engage the first blocking surface of the trigger when pulled to allow cocking the hammer. The firearm further includes a biasing member urging the magazine disconnect member into the blocking position. The magazine disconnect member is operable such that inserting the magazine into the frame moves the magazine disconnect member from the blocking position to the non-blocking position, and removing the magazine from the frame moves the disconnect member from the non-blocking position to the blocking position to prevent discharging the firearm.

According to another exemplary embodiment of the present invention, an auto-loading firearm with magazine disconnect mechanism includes a frame defining a longitudinal axis and a chamber for holding a cartridge, a magazine removably disposed in the frame and adapted for holding a plurality of cartridges loadable into the chamber, a firing control mechanism including a trigger bar coupled to a trigger pivotably mounted in the frame, the trigger being operable via the trigger bar to discharge the firearm, and a magazine disconnect plate slidably disposed in the frame for forward and rearward axial horizontal movement in response to removing and inserting the magazine. The magazine disconnect plate preferably is selectively engageable with the trigger between a blocking position in which the disconnect plate engages the trigger when pulled and a non-blocking position in which the disconnect plate does not engage the trigger when pulled allowing full rotational or pivotal movement of the trigger to discharge the firearm. The firearm further includes a biasing member such as a spring urging the magazine disconnect plate into the blocking position. The magazine disconnect member is operable such that inserting the magazine into the frame moves the magazine disconnect plate from the blocking position to the non-blocking position, removing the magazine from the frame causes the spring to move the disconnect plate from the non-blocking position to the blocking position in which movement of the trigger is restricted to prevent discharging the firearm. The spring is movable from a compressed state when the magazine disconnect plate is in the non-blocking position to an expanded state when the magazine disconnect plate is in the blocking position. Movement of the spring into the expanded state forces the magazine disconnect plate into the blocking position. In one embodiment, the firing control mechanism further includes a hammer pivotably mounted in the frame wherein the trigger is operable via the trigger bar to cock and release the hammer for discharging the firearm. In one embodiment, the firing control mechanism may also include a firing pin which is engageable by the hammer and movable in a forward direction to strike a chambered cartridge.

According to another aspect of the present invention, a method for blocking the discharge of a firearm is provided. In one embodiment, the method includes: providing a firearm having a frame including a removable magazine for holding a plurality of cartridges and a trigger pivotably moveable for discharging the firearm; removing the magazine from the firearm; axially sliding a spring-biased magazine disconnect member in a first direction into engagement with the trigger in response to removing the magazine wherein movement of the trigger is restricted to prevent discharging the firearm. In a further embodiment, the method further includes: reinserting the magazine into the firearm; and axially sliding the magazine disconnect member in a second direction opposite the first direction out of engagement with the trigger in response to reinserting the magazine wherein movement of the trigger is unrestricted to allow discharging the firearm. In some embodiments, the first direction is rearward and the second direction is forward. According to another embodiment, the foregoing method may further include expanding a spring acting on the magazine disconnect member by removing the magazine from the firearm to slide the disconnect member in the first direction, and compressing the spring by reinserting the magazine back into the firearm which further slides the disconnect member in the second direction. In preferred embodiments, the magazine disconnect member may be configured as a generally flattened plate.

BRIEF DESCRIPTION OF THE DRAWINGS

The features of the preferred embodiments will be described with reference to the following drawings where like elements are labeled similarly, and in which.

Figure 1:
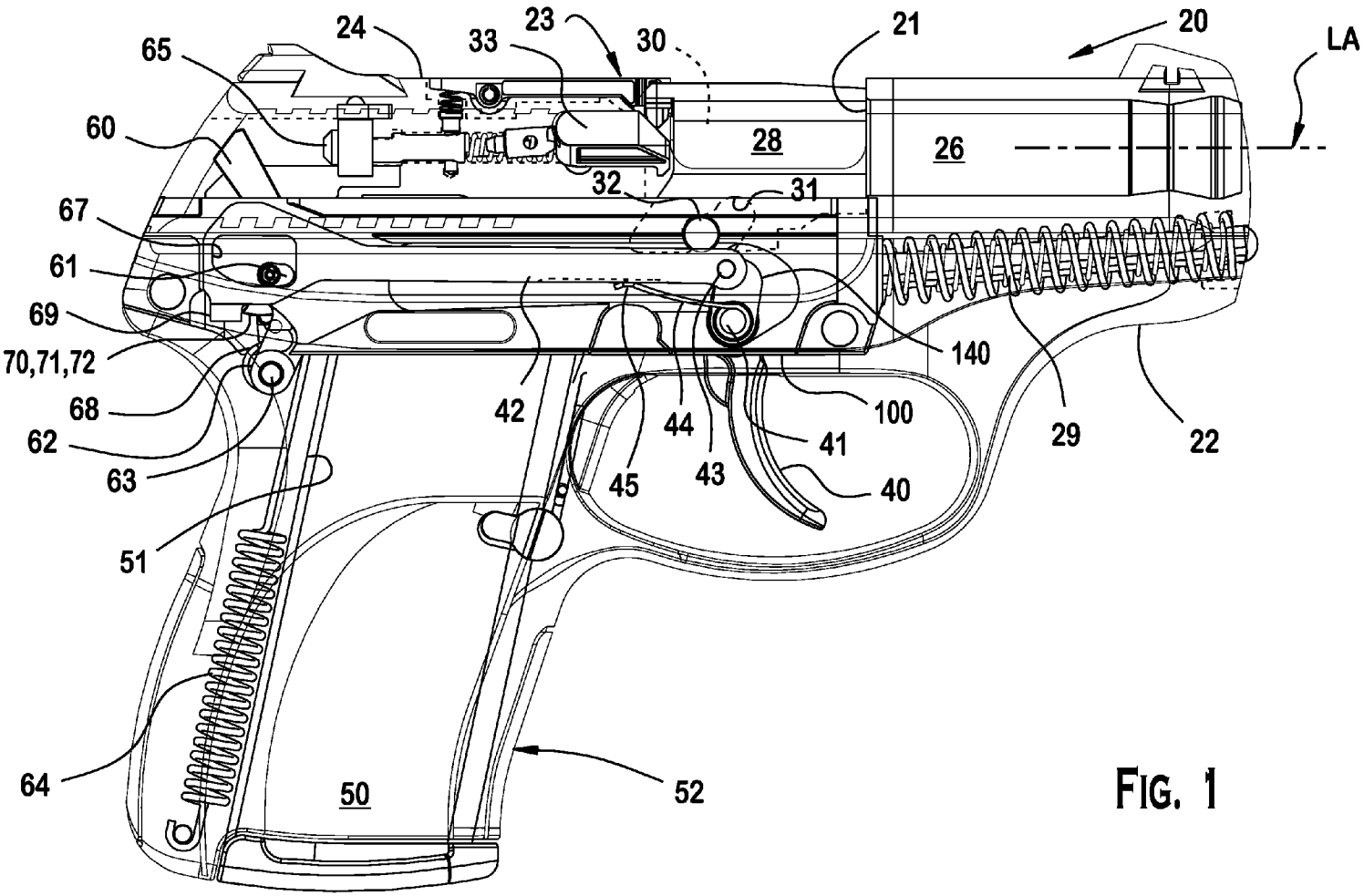
FIG. 1 is a right side view of one embodiment of a pistol showing the internal firing control mechanism.

All drawing shown herein are schematic and not to scale.

DESCRIPTION OF PREFERRED EMBODIMENTS

The features and benefits of the invention are illustrated and described herein by reference to preferred embodiments. This description of preferred embodiments is intended to be read in connection with the accompanying drawings, which are to be considered part of the entire written description. In the description of embodiments disclosed herein, any reference to direction or orientation is merely intended for convenience of description and is not intended in any way to limit the scope of the present invention. Relative terms such as "lower," "upper," "horizontal," "vertical," "above," "below," "up," "down," "top" and "bottom" as well as derivative thereof (e.g., "horizontally," "downwardly," "upwardly," etc.) should be construed to refer to the orientation as then described or as shown in the drawing under discussion. These relative terms are for convenience of description only and do not require that the apparatus be constructed or operated in a particular orientation. Terms such as "attached," "affixed," "connected," "coupled," "interconnected," and similar refer to a relationship wherein structures may be secured or attached to one another either directly or indirectly through intervening structures, as well as both movable or rigid attachments or relationships, unless expressly described otherwise. Moreover, the features and benefits of the invention are illustrated by reference to the preferred embodiments. Accordingly, the invention expressly should not be limited to such preferred embodiments illustrating some possible non-limiting combination of features that may exist alone or in other combinations of features; the scope of the invention being defined by the claims appended hereto.

An exemplary auto-loading firearm incorporating one exemplary embodiment of a magazine disconnect mechanism according to principles of the present invention will now be described for convenience with reference to a semi-automatic pistol. The principles and features of the embodiments disclosed herein, however, may be used with equal benefit for other types of auto-loading firearms including compact or full-size pistols and rifles that include removable magazines. Accordingly, the invention is not limited in its applicability or scope to pistols alone as described herein.

Figure 2:
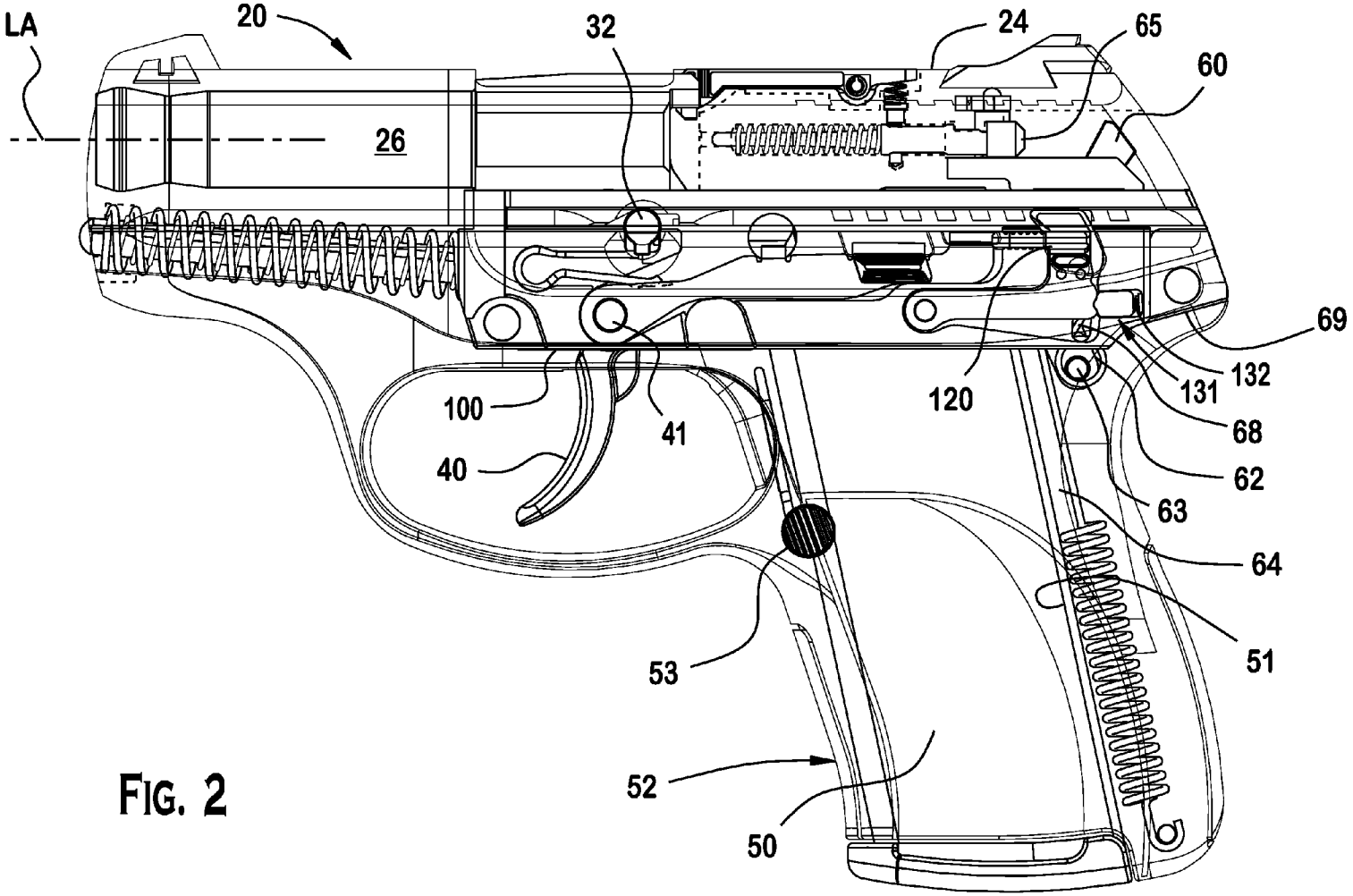
FIG. 2 is a left side view of the pistol of FIG. 1.
Figure 3:
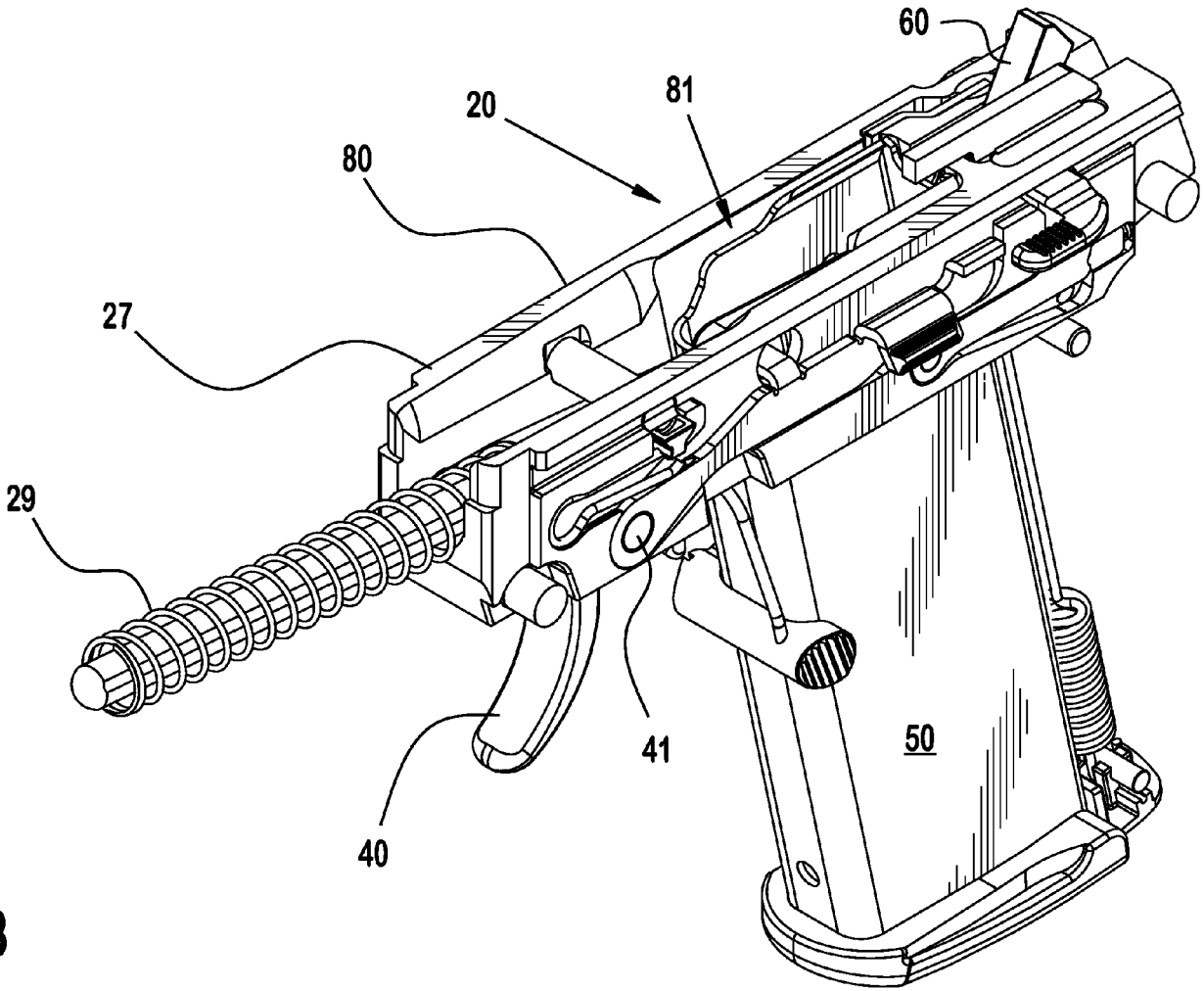
FIG. 3 is a left side perspective view of the firing control housing and mechanism of the pistol of FIG. 2 showing the magazine being inserted therein.
Figure 4:
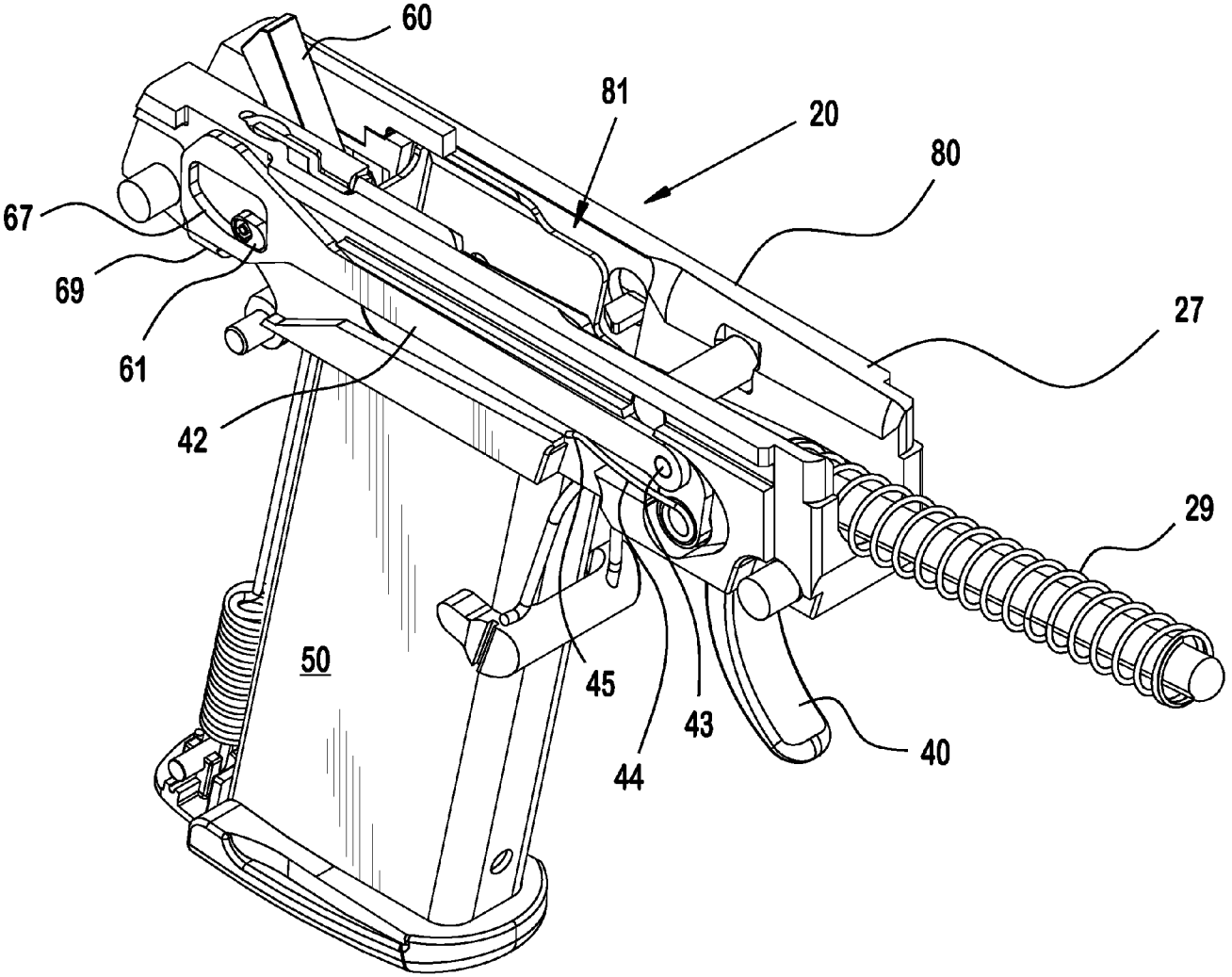
FIG. 4 is a right side perspective view of the firing control housing and mechanism of the pistol of FIG. 1 showing the magazine being inserted therein.

FIGS. 1 and 2 depict right and left side views of a pistol 20 respectively showing the firing control mechanism components with the frame and slide of the pistol shown superimposed in phantom view (in lighter solid lines) to better reveal these components and their relative positions as mounted therein. FIGS. 3 and 4 depict left and right side views of the firing control housing which supports the various firing control mechanism components, without the frame, slide, or barrel shown for clarity.

Referring now to FIGS. 1-4, pistol 20 includes a grip frame 22 and firing control housing 80 mounted therein that supports a plurality of firing control mechanism components, as further described herein. A slide 24 is slidably mounted on firing control housing 80 via a conventional support rail and slide groove system for axial reciprocating movement forwards and rearwards thereon. Recoil spring 29 is operably associated with slide 24 and acts to return the slide forward to the position shown in FIGS. 1 and 2 after discharging pistol 20. A magazine 50 is removably inserted into frame 22 and firing control housing 80 as further described herein. Magazine 50 is sized and configured for holding and dispensing a plurality of cartridges C (see FIGS. 9-10).

Figure 9:
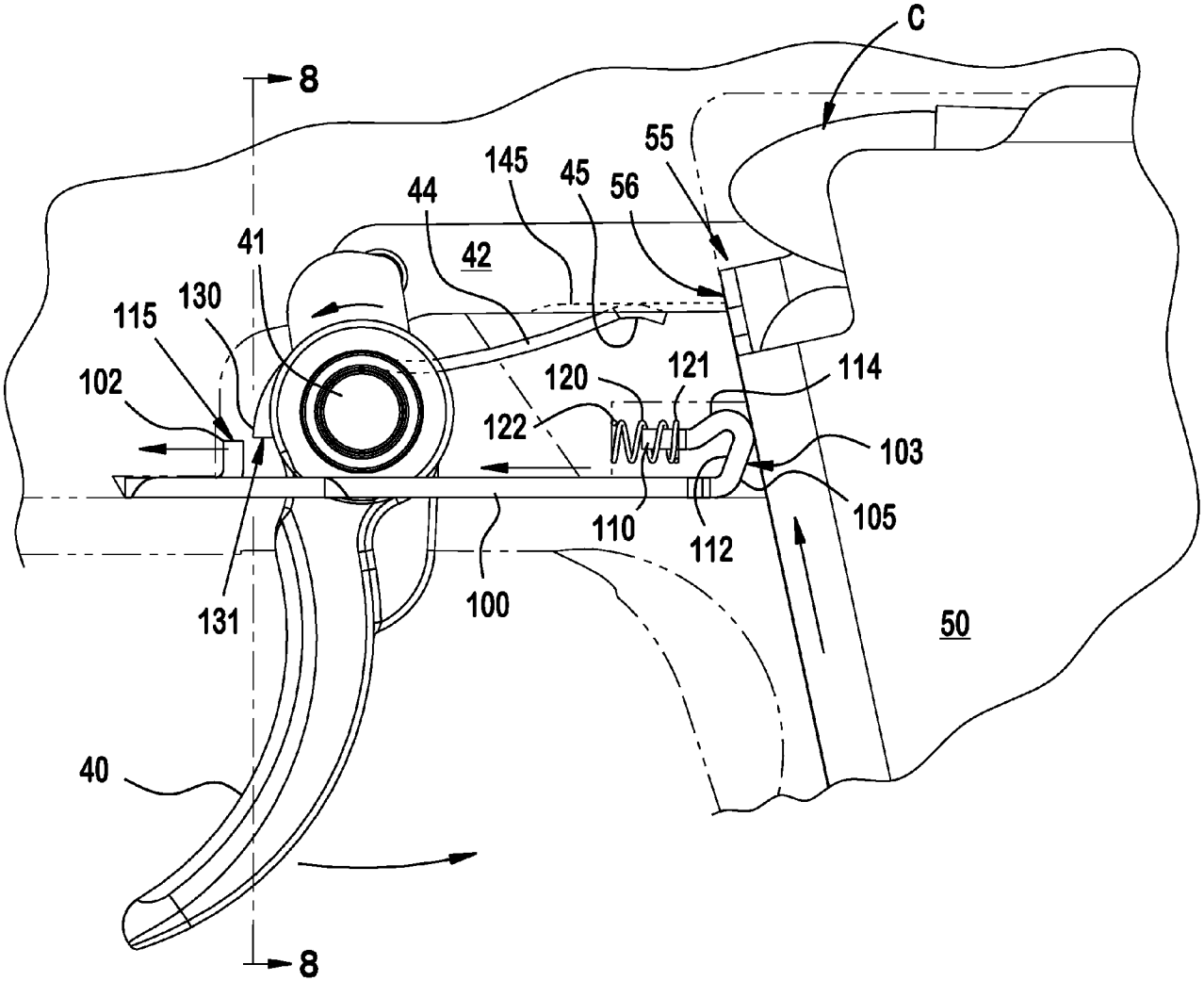
FIG. 9 is a side view of the magazine disconnect mechanism of FIG. 5 shown disembodied from the pistol of FIG. 2 with the magazine positioned in the pistol and magazine disconnect member being in a trigger non-blocking position.
Figure 10:
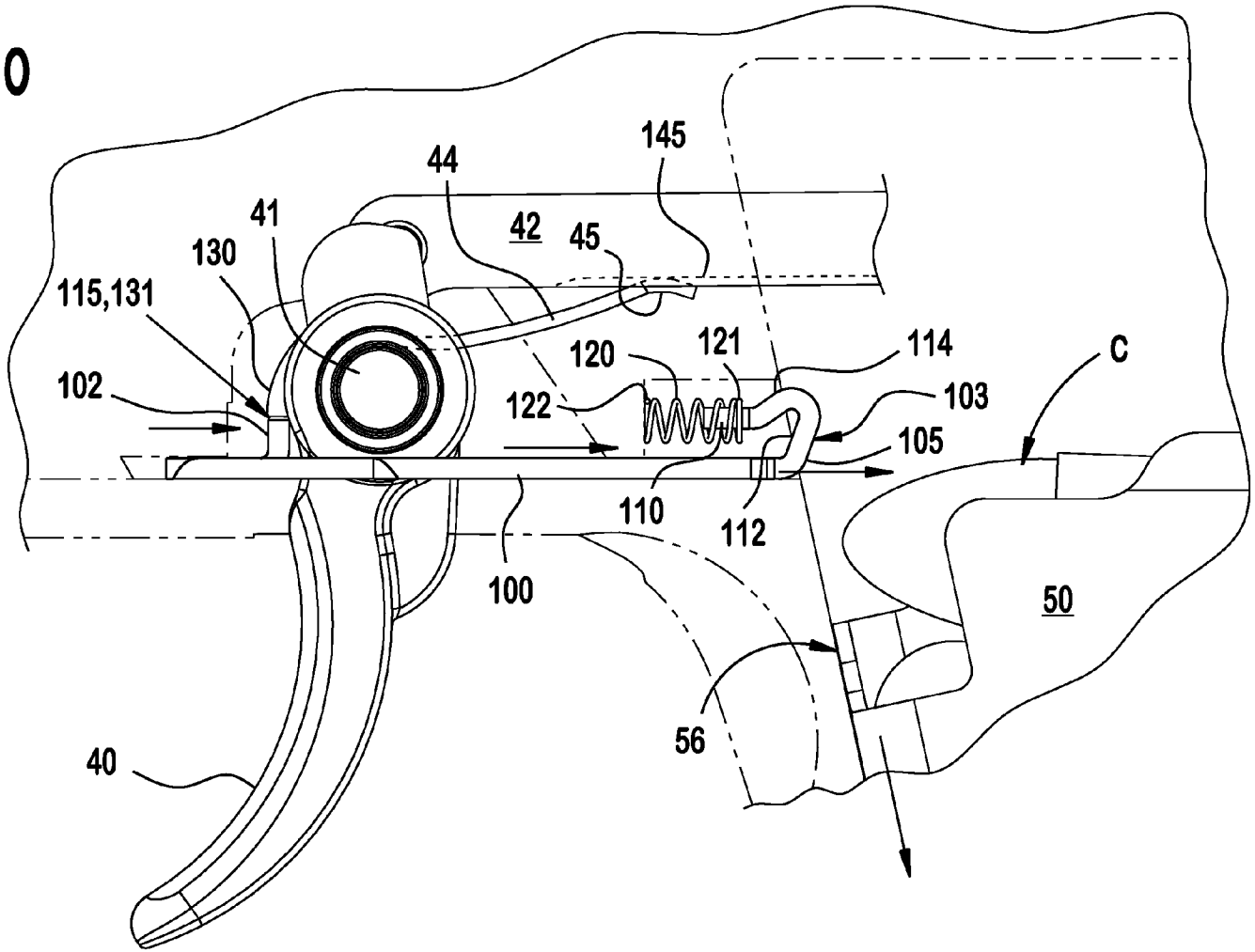
FIG. 10 is a side view of the magazine disconnect mechanism of FIG. 5 shown disembodied from the pistol of FIG. 2 with the magazine being removed from the pistol and magazine disconnect member being in a trigger blocking position.

Pistol 20 further includes a barrel 26 that is movably disposed at least partially inside slide 24 and includes a rear chamber block 28 defining an open chamber 30 therein configured for receiving a cartridge C (shown in FIGS. 9-10). Breech area 23 is located at the rear of barrel 26 and chamber 30 for loading cartridges C therein. Pistol 20 further defines a longitudinal axis LA having an axial direction and which is approximately centrically aligned with barrel 26 and slide 24 as shown in FIGS. 1 and 2. Barrel 26 is moveable rearwards with slide 24 on firing control housing 80 in a conventional manner due to recoil after discharging pistol 20. Barrel 26 includes a conventional cam track or slot 31 configured to engage a corresponding camming cross pin 32 mounted transversely in frame 22 for arresting the rearward movement of the barrel after discharging pistol 20 (not shown). Cross pin 32 limits and stops rearward movement of barrel 26 after traveling a relatively short distance rearwards upon discharging pistol 20. This allows slide 24 to continue moving rearwards alone, thereby opening breech area 23 so that a spent cartridge casing may extracted from chamber 30 by extractor 33 and ejected from pistol 20 through ejector port 21 in the slide. Thereafter, recoil spring returns slide 24 forward stripping a new cartridge from a magazine 50 and inserting the cartridge into chamber 30. Breech area 23 is re-closed and both slide 24 and barrel 26 are brought forward together to the ready-to-fire position shown in FIGS. 1 and 2.

With continuing reference to FIGS. 1-4, a firing control mechanism in one embodiment includes trigger assembly including trigger 40 pivotally mounted in frame 22 to firing control housing 80 via transverse pin 41, axially movable trigger bar 42 pivotally coupled to the trigger via transverse pin 43, hammer 60 pivotally mounted to firing control housing 80 via transverse pin 61, hammer stop 62 pivotally mounted to grip frame 22 via transverse pin 63 and engageable with the hammer, and axially movable spring-loaded firing pin 65 supported by slide 24 and positioned to be contacted by the hammer and driven forward to strike a chambered cartridge C (see FIG. 9) in a conventional manner. The combination of hammer 60 and firing pin 65 together define a means for striking a chambered cartridge to discharge firearm 20. Hammer spring 64, which may be a tension spring as shown or other suitable spring, connects to a lower portion of hammer 60 forward of pin 61 and biases the hammer forward towards firing pin 65. Trigger spring 44 may be a torsion spring as shown that is mounted about pin 41 and biases trigger 40 toward the fully forward ready-to-fire position shown in FIGS. 1 & 4. Trigger spring 44 further includes a rearwardly and laterally-extending leg 45 which acts on the underside of trigger bar 42 (best shown in FIGS. 4 and 9-10) to bias the trigger bar upwards towards engagement with hammer 60. In one embodiment, leg 45 may be disposed in an elongated slot or recess 145 formed in the underside of trigger bar 42 as shown in FIGS. 9 and 10 to maintain positive engagement between spring 44 and the trigger bar.

With continuing reference to FIGS. 1-4, trigger bar 42 may be a generally flat and relatively thin plate-like structure having an elongated configuration. In one embodiment, the rear portion of trigger bar 42 may be enlarged and further defines a window 67 which receives hammer pin 61 therein. Window 67 interacts with hammer pin 61 to provide a vertical stop for limiting the upward position of trigger bar 42 under the biasing force of trigger spring 44 via a lower portion and surface of window 67 engaging the hammer pin as shown in FIG. 1.

To operably engage hammer 60 for cocking and releasing the hammer to discharge pistol 20, trigger bar 42 in one embodiment includes a laterally-extending portion such as trigger bar protrusion 69 as shown in FIGS. 1 and 4. In one embodiment, trigger bar protrusion 69 may be configured as a generally flat flange projecting laterally inwards from trigger bar 42 when mounted in the pistol and firing control housing 80. Trigger bar protrusion 69 is configured and positioned to operably engage a portion of hammer 60. In one embodiment, trigger bar protrusion 69 engages an operating portion 72 of hammer 60, which may be located on a lower portion 71 of hammer 60. Operating portion 72 may include a rear operating surface 70 in a preferred embodiment (see FIG. 1). In one embodiment, rear surface 70 may be concave in shape thereby forming an arcuate hook on operating portion 72 of hammer 60. This provides smooth movement and release of hammer 60 when operably engaged and cocked by trigger bar protrusion 69 of trigger bar 42.

Hammer stop 62 preferably is biased into engagement with hammer 60 by hammer stop spring 68 mounted about hammer stop pin 63 as shown in FIG. 1. When hammer 60 is cocked in the ready-to-fire position shown in FIGS. 1-3, hammer stop 62 preferably is engaged with hammer 60. Hammer stop 62 holds hammer 60 in the cocked position and prevents the hammer from being released in the absence of a trigger pull.

Operation of the firing control mechanism will now be described. Starting with pistol 20 in the ready-to-fire position shown in FIGS. 1-4, hammer 60 is shown cocked rearwards with an upper lever portion being aligned to strike but spaced apart from firing pin 65. Lateral trigger bar protrusion 69 of trigger bar 42 is axially aligned with rear surface 70 of hammer 60. Pulling trigger 40 causes a protruding upper portion or lever 140 of the trigger containing transverse pin 41 to rotate forwards about trigger pin 41 and similarly pulls trigger bar 42 axially forward. As trigger bar 42 moves forward, trigger bar protrusion 69 engages rear surface 70 of hammer 60 below pin 61 to rotate and cock the hammer rearwards. Trigger bar protrusion 69 continues forward to contact and disengage hammer stop 62 from hammer 60 and holds the hammer stop in a forward position while releasing the hammer. Hammer 60 rotates forward under the biasing force of hammer spring 64 and strikes the rear of firing pin 65, driving the firing pin forward to strike and a chambered cartridge and discharge pistol 20. After discharging pistol 20, the firing control mechanism returns to the ready-to-fire position shown in FIGS. 1-4 in a convention manner under the biasing force of recoil spring 29.

In alternative embodiments and arrangements of a firing control mechanism, the means for striking a chambered cartridge to discharge firearm 20 may be a "striker" as commonly referred to in the art. Exemplary embodiments of such striker-fired firearms and firing mechanisms are shown in U.S. patent application Ser. No. 11/881/069, entitled "Striker-Fired Firearm," which is incorporated herein by reference in its entirety.

Striker mechanisms essentially replace the pivoting hammer and axially movable firing pin arrangement already described herein with a single spring-loaded axially movable striker component that incorporates the functions and features of the firing pin. The striker is moved axially rearward and then released forward to strike a chambered cartridge with the narrow forward end of the striker via the trigger and trigger bar arrangement in a similar manner to that already described herein with reference to the hammer and firing pin arrangement. Accordingly, the magazine disconnect mechanism described herein is not limited in its application to either a combination hammer and firing pin or a striker type means for striking a chambered cartridge since the pivotable movement of the trigger 40 sufficient to activate either type of these cartridge-striking systems is restricted or arrested by the magazine disconnect mechanism further described herein.

According to one aspect of the present invention, a magazine disconnect mechanism is provided for pistol 20 that prevents the firing control mechanism from being actuated sufficiently to discharge the pistol after magazine 50 has been removed. Referring initially to FIGS. 1-4 and 8, magazine 50 is removably insertable upwards into firing control housing 80 through magazine well or opening 81 therein and downwardly open cavity 51 formed in the grip portion 52 of grip frame 22. Magazine 50 holds a plurality of cartridges C and operates in a conventional manner having a spring-loaded floor plate (not shown) well known to those skilled in the art which urges the cartridges upwards for being selectively stripped off by slide 24 and automatically loaded into chamber 30 by the slide when the action of pistol 20 is cycled such as by discharging the pistol.

Figure 5:
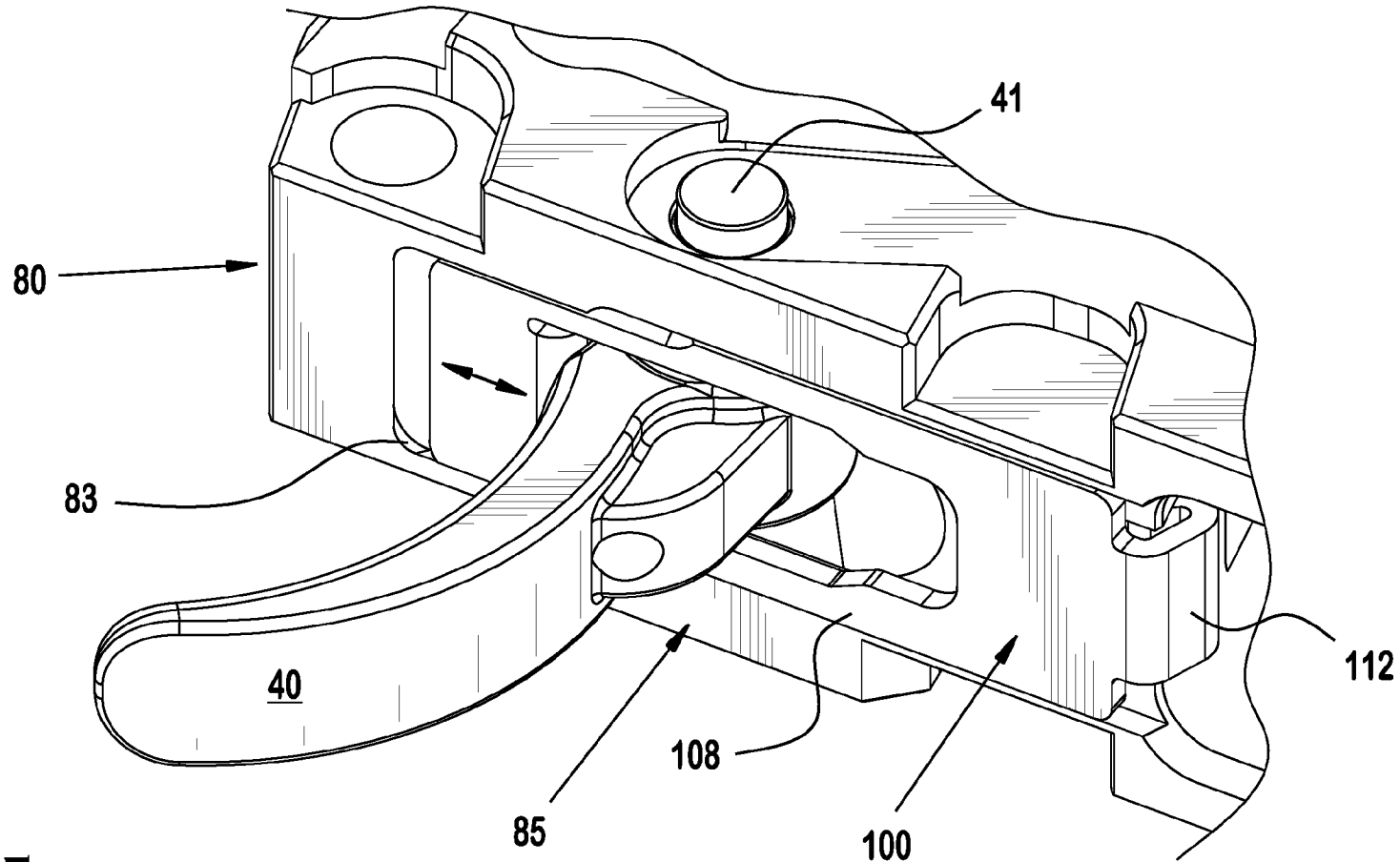
FIG. 5 is a partial bottom view of the firing control housing of the pistol of FIG. 2 showing a trigger mechanism with associated magazine disconnect member.

With additional reference now to FIG. 5 showing a partial bottom perspective view of a pertinent portion of firing control housing 80, the magazine disconnect mechanism includes a spring-biased magazine disconnect member which in one possible embodiment may be configured as a plate 100. Magazine disconnect plate 100 is operably and movably responsive in position to insertion and removal of magazine 50 into/from pistol 20 via engagement by the magazine. In one preferred embodiment, magazine disconnect plate 100 is horizontally slidably disposed within frame 22 for forward and rearward axial movement in a plane and direction generally parallel to longitudinal axis LA of pistol 20 (shown in FIG. 1). In one embodiment, magazine disconnect plate 100 may preferably be restricted to sliding motion within in a single plane only as further described herein.

Figure 6:
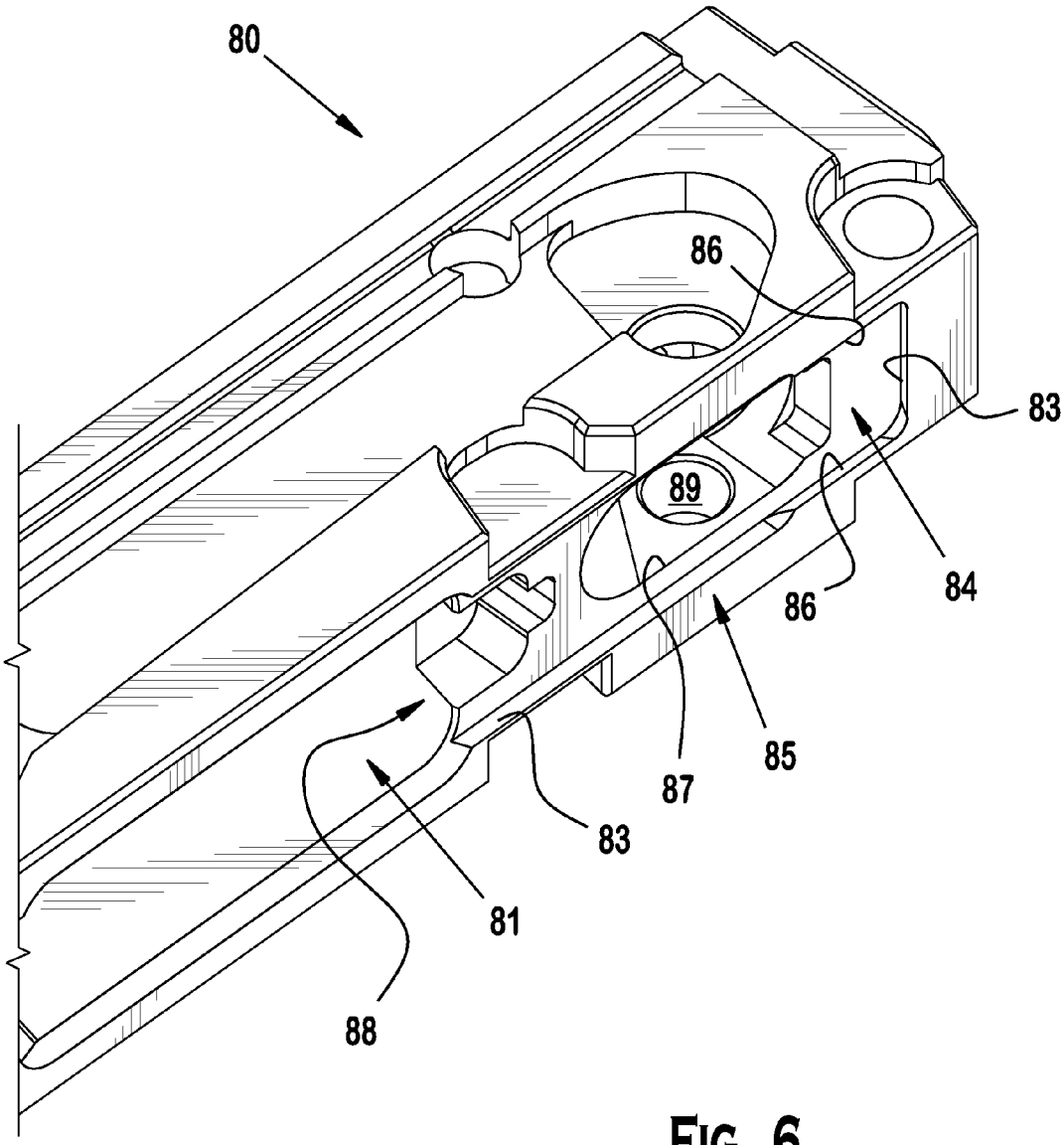
FIG. 6 is a partial bottom view of the firing control housing alone of the pistol of FIG. 1.
Figure 8:
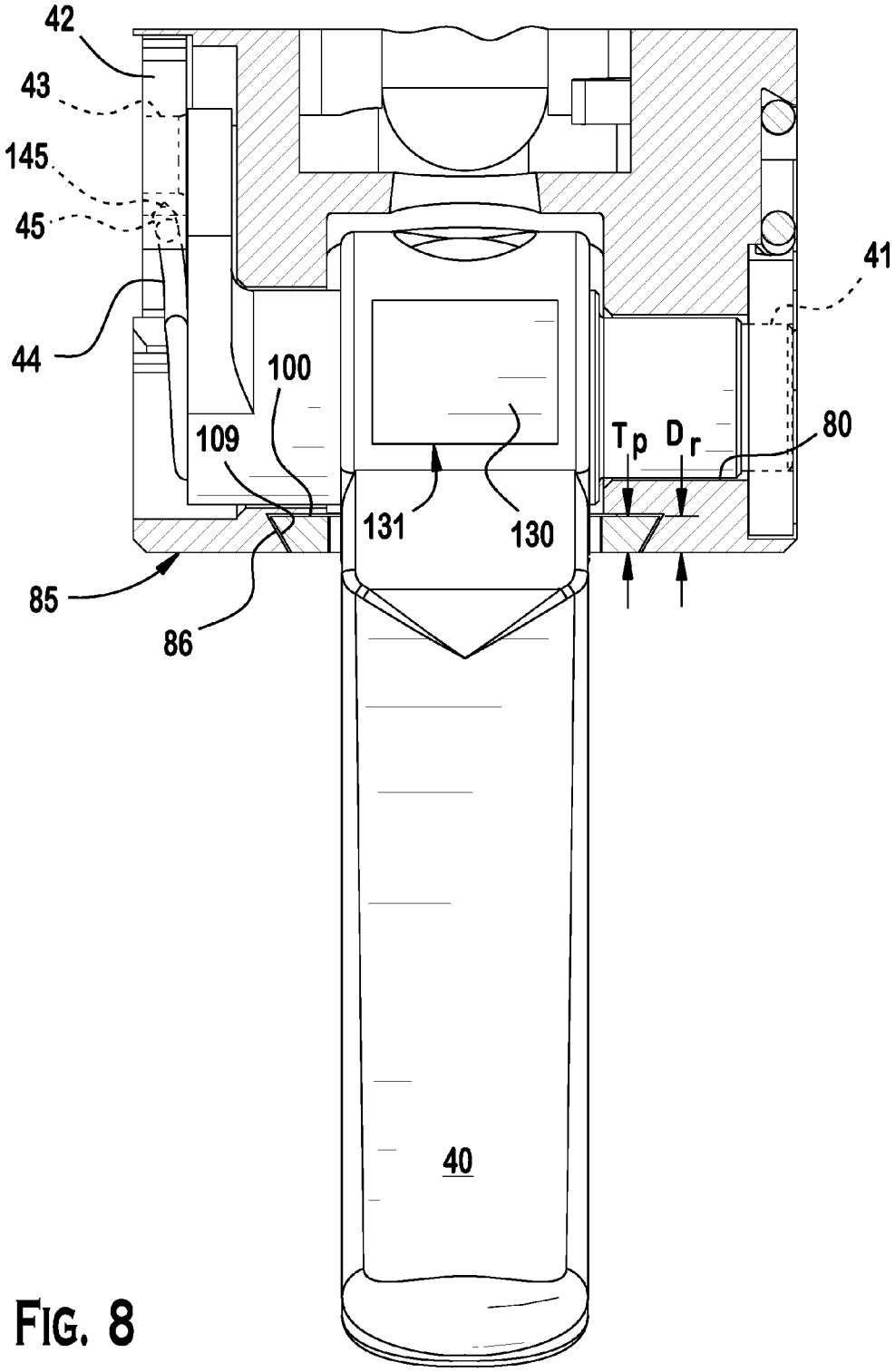
FIG. 8 is a lateral cross-sectional view taken along line 8-8 in FIG. 9 and showing a portion of the trigger.

In one embodiment, magazine disconnect plate 100 may be positioned and slidably mounted in an axially elongated retaining recess 83 which may be formed in the bottom surface 85 of firing control housing 80 as shown in FIGS. 5 and 6. Retaining recess 83 is sized and configured to complement the shape of disconnect plate 100 and accommodate sliding forward and rearward movement therein. Accordingly, recess 83 preferably has an axial length longer than the axial length of magazine disconnect plate 100 to allow space for the member to slide forward and rearward. In one embodiment, recess 83 preferably has a depth Dr which is approximately the same as but slightly deeper than the thickness Tp of magazine disconnect plate 100 (see FIG. 8) so that the plate is substantially flush with the bottom surface 85 of firing control housing 80 as shown in FIGS. 5 and 8. This arrangement beneficially makes the magazine disconnect plate 100 substantially flush with the portion of grip frame 22 above trigger 40 within the finger loop (see, e.g. FIG. 1) to prevent snagging a user's finger when pulling the trigger rearward to discharge pistol 20.

FIG. 6 is a partial bottom perspective view of a pertinent portion of firing control housing 80 including elongated plate retaining recess 83. Trigger pivot pin hole 89 which receives trigger pivot pin 41 is identified for orientation purposes. Recess 83 is preferably positioned forward of magazine well or opening 81 in firing control housing 80 and includes an opening 87 leading to an internal space to accommodate trigger 40 and portions of magazine disconnect plate 100 therein (see, e.g. FIG. 5). Recess 83 further defines a downward facing flat or planar sliding surface 84 disposed within the recess which is vertically inset from bottom surface 85 of firing control housing 80. Sliding surface 83 engages corresponding upward facing top sliding surface 107 of magazine disconnect plate 100 (best shown in FIG. 7). As shown in FIG. 6, sliding surface 84 may be interrupted by various cutouts such as opening 87, and therefore need not be contiguous so long as sufficient surface area is available for adequately supporting magazine disconnect plate 100 to allow for smooth sliding of the disconnect plate when actuated.

Figure 7:
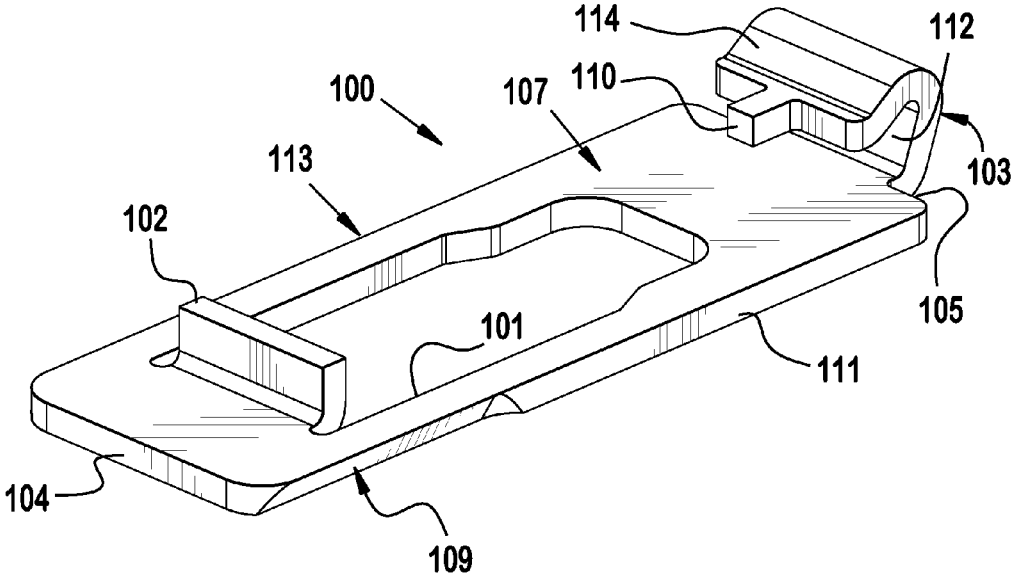
FIG. 7 is a top perspective view of the magazine disconnect member of FIG. 5.

In one embodiment, magazine disconnect plate 100 advantageously may be slidably retained within recess 83 of firing control housing 80 without the need for pins or similar additional retaining elements. Referring to one non-limiting embodiment shown in FIGS. 5-7, and as best shown in the cross-sectional view in FIG. 8 taken from FIG. 7, magazine disconnect plate 100 may be slidably retained in recess 83 of firing control housing 80 by a pair of spaced apart and mutually engaging dovetailed angled or sloping surfaces 86 and 109. Recess 83 defines a pair of spaced apart sloping surfaces 86 disposed on opposite lateral sides of the recess as shown in FIG. 6. These sloping surfaces 86 mate with and engage complementary shaped sloping surfaces 109 disposed on each opposite lateral side of magazine disconnect plate 100 as shown in FIG. 7. To ensure that plate 100 is slidably retained in recess 83, sloping surfaces 86 on firing control housing 80 are sloped or angled inwards and downwards toward trigger 40 as shown in FIG. 8 such that the bottom edge of each surface 86 is located closer to trigger 40 than the opposite upper edge which is farther away. Accordingly, sloping surfaces 86 face inwards towards trigger 40. Similarly, the bottom edge of each sloping surface 109 on magazine disconnect plate 100 is located closer to trigger 40 than the opposite upper edge which is farther away. However, and conversely oriented to the sloping surfaces 86 on firing control housing 80, sloping surfaces 109 on magazine disconnect plate 100 face outwards instead away from trigger 40. This creates a sliding interference fit between surfaces 86 and 109 as shown in FIGS. 5 and 8 which prevents the plate 100 from falling downwards through retaining recess 83 when mounted in firearm 20.

To install the magazine disconnect plate 100 into retaining recess 83 of firing control housing 80 in view of the dovetailed sloping surfaces arrangement, the recess 83 preferably has a rear facing opening 88 as shown in FIG. 6 that allows the plate to be slidably inserted therein from the magazine well or opening 81 in the firing control housing. Advantageously, the foregoing magazine disconnect plate 100 retaining system is mechanically simple and cost-effective by providing sliding movement of the plate within the retaining recess 83 while eliminating the need for additional pins or similar retaining elements to movably maintain the plate in position with the firing control housing 80.

Magazine disconnect plate 100 will now be described in further details with initial reference to FIG. 7, which is a top perspective view the plate. In one embodiment, magazine disconnect plate 100 has a generally planar or flat longitudinally elongated body 113 including a central opening 101 for receiving a portion of trigger 40 there through as shown in FIG. 5. Magazine disconnect plate 100 further includes a front end 104, a rear end 105, a pair of longitudinally-extending lateral sides 111 between the ends, top surface 107, and a bottom surface 108 (shown in FIG. 5). Sloping surfaces 109 are preferably disposed proximate to front end 104 of plate 100 to ensure a relatively tight and positive interlock with complementary mating sloping surfaces 86 on firing control housing 80.

In one embodiment, the rear end 105 of magazine disconnect plate 100 is configured to operably engage magazine 50 when inserted into and removed from pistol 20 for actuating the magazine disconnect system. Referring to FIGS. 7 and 9, rear end 105 is therefore preferably positioned and configured for contact by magazine 50 and acts as a sensing element for detecting the presence or absence of the magazine in pistol 20 and sliding the magazine disconnect plate 100 in response thereto.

With continuing reference to FIGS. 7 and 9, rear end 105 in one embodiment is configured to include a vertical and upward extending turned sensing portion or protrusion 112 which defines a vertically and laterally extending rear facing magazine contact surface 103. Protrusion 112 may be most economically formed by rolling and bending a rear portion of magazine disconnect plate 100 to obtain the desired configuration and profile as shown. In other embodiments, protrusion 112 may alternatively be formed from a separate element attached to rear end 105 by any suitable fabrication method conventionally used in the art in lieu of being an integral part of plate 100. Sensing protrusion 112 may have a lateral width coextensive with or less than the width of the magazine disconnect plate body 113 so long as sufficient width is provided to ensure position engagement with magazine 50.

Referring to FIGS. 7 and 9, contact surface 103 of magazine disconnect plate 100 is engageable with an upper front portion 55 and front facing forwardly inclined contact surface 56 defined thereon of magazine 50 when inserted into open cavity 51 formed in the grip portion 52 of pistol grip frame 22. In one preferred embodiment, contact surface 103 is inclined and angled in a rearward direction (as best shown in FIG. 9) and disposed at an angle preferably from and including 0 degrees to and including about 90 degrees in relation to the horizontal top surface 107 of magazine disconnect plate body 113 as shown in FIG. 9. The upturned sensing protrusion 112 adds height and vertical surface area to contact surface 103 to ensure positive engagement by the forwardly angled upper front portion 55 of magazine 50 and actuation of magazine disconnect plate 100 in response thereto. However, it will be appreciated that in other embodiments rear end 105 may be formed without an upturned protrusion or portion and be fully functional.

With continuing reference to FIGS. 7 and 9, the magazine disconnect mechanism of pistol 20 preferably includes a biasing member such as without limitation helical spring 120 which urges magazine disconnect plate 100 rearwards towards engagement with magazine 50. In one preferred embodiment, spring 120 preferably acts on a portion of magazine disconnect plate 100 to the rear of trigger 40 to ensure positive engagement with magazine 50. In one possible preferred embodiment, spring 120 acts on rear end 105 of plate 100 proximate to magazine 50 via having one rear spring end 121 engaged with a forward extending spring mounting portion 114 of sensing protrusion 112 and an opposite front spring end 122 engaged with firing control housing 80. Spring mounting portion 114 may include a tab 110 which receives and retains rear spring end 121 of spring 120 on spring mounting portion 114 to prevent slippage of the spring off of the plate 100.

It will be appreciated that other mounting arrangements and placement of spring 120 are possible so long as magazine disconnect plate 100 is biased rearwards towards engagement with magazine 50. Accordingly, spring 120 may act on other portions or appurtenances provided on magazine disconnect plate 100 including portions front of trigger 40 or on the front end 104 of plate 100. The invention is therefore not limited to the preferred placement of spring 120 described above. It will be further appreciated that other suitable formed of springs other than helical may be used and the invention is not limited to any particular type of spring so long as the desired functionality described herein is maintained.

Referring now to FIGS. 5-10, magazine disconnect plate 100 further includes a trigger blocking protrusion such as blocking flange 102 that is engageable with trigger 40 in one position for restricting or preventing movement of the trigger sufficient to cock and release hammer 60 to discharge pistol 20. In one possible preferred embodiment, blocking flange 102 extends in a vertical and upwards direction from top surface 107 and engages a complementary configured and oriented forward-extending blocking protrusion such as blocking ledge 130 disposed on the front portion of trigger 40. Blocking flange 102 defines an upward facing blocking surface 115 which mates and is engageable with downward facing blocking surface 131 defined on ledge 130 when magazine disconnect plate 100 is in a blocking position as shown in FIG. 10. Blocking ledge 130 may have approximately the same lateral width or be narrower than the width of blocking flange 102, and vice versa. In one possible embodiment as shown, blocking flange 102 is preferably located on a front portion of magazine disconnect plate body 113 forward of trigger 40 and is slidably movable in a forward and rearward axial direction into and out of engagement with the trigger. Preferably, sloping surfaces 109 on magazine disconnect plate 100 are preferably disposed laterally adjacent to blocking flange 102 to ensure a relatively tight and positive interlock with complementary mating sloping surfaces 86 on firing control housing 80 and resist dislodgement of the plate from recess 83 since this is the location where the greatest downwards direct-acting force is imparted to the plate from trigger 40.

Figure 11:
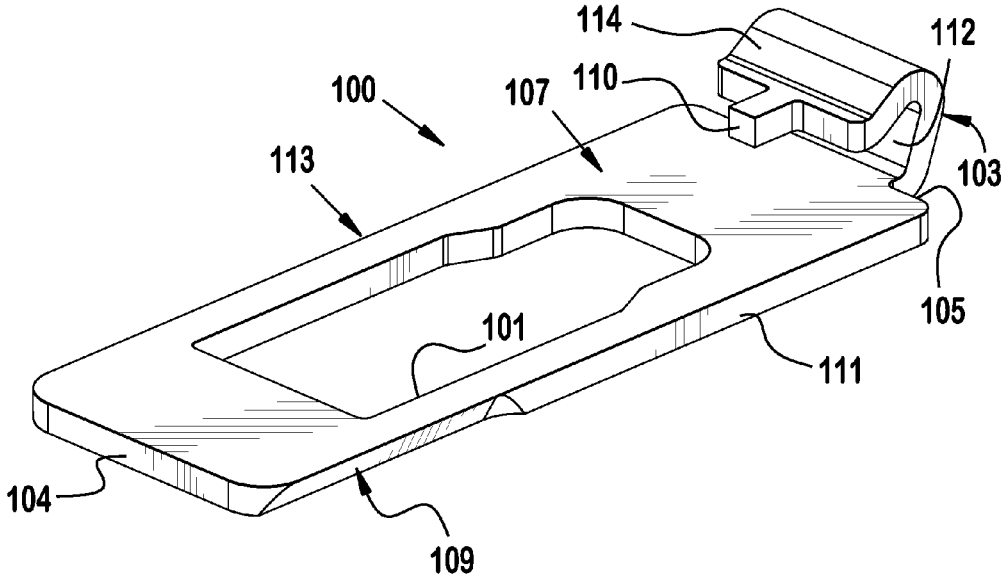
FIG. 11 is a top perspective view of an alternative embodiment of a magazine disconnect member shown in FIG. 5.

It will be appreciated that in some alternative embodiments, blocking flange 102 may be omitted and upward facing blocking surface 115 may instead be defined as part of top surface 107 of magazine disconnect plate 100 located in the same position as flange 102 shown in FIG. 7. In this alternative embodiment shown in FIG. 11, top surface 107 mates and is engageable with downward facing blocking surface 131 defined on ledge 130 directly. It is well within the ambit of those skilled in the art to implement such an arrangement without further description or discussion.

Blocking flange 102 may be formed by any suitable method conventionally used in the art. In one preferred embodiment, blocking flange 102 may be most economically formed by rolling and bending a tab-like portion of magazine disconnect plate upwards as shown in FIG. 7 to obtain the desired configuration and profile. In other possible embodiments, flange 102 may alternatively be formed from a separate element attached to the top surface 107 of magazine disconnect plate 100 by any suitable fabrication method conventionally used in the art in lieu of being an integral part of the plate.

Magazine disconnect plate 100 may be formed from any suitable material including without limitation metals or polymers having relatively rigid mechanical properties. Preferably, plate 100 is made of a material and has sufficient thickness (measured vertically between top and bottom surfaces 107, 108) to provide strength sufficient to resist deformation when acted on by trigger 40 in the blocking position shown in FIG. 10 if a user attempts to pull the trigger rearward without magazine 50 seated in pistol 20. It is well within the ambit of those skilled in the art to select an appropriate material and plate thickness to achieve the foregoing functionality without undue experimentation. In one preferred embodiment, magazine disconnect plate 100 is made of metal such as aluminum, steel, titanium, or alloys thereof.

The operation of the magazine disconnect mechanism will now be described with primary reference to FIGS. 5 and 9-10. Magazine disconnect plate 100 is slidably movable in an axial direction in response to inserting and removing magazine 50 from a first forward unblocking position shown in FIG. 9 corresponding to magazine 50 being fully inserted into pistol 20, to a second rearward blocking position shown in FIG. 10 corresponding to magazine 50 being removed from the pistol. The second blocking position generally immobilizes the trigger 40 such that a trigger pull will not rotate and cock the hammer 60 a sufficient amount to discharge pistol 20, thereby disabling the firing control mechanism.

Beginning with FIG. 9, magazine 50 is shown in a position corresponding to the magazine being fully inserted in pistol 20. Magazine disconnect plate 100 is shown in the first unblocking position being engaged with and forced into a forward-most position by magazine 50 against the rearward biasing force of magazine disconnect spring 120 acting on the plate. When magazine 50 is initially inserted into and seated in magazine cavity 51 of pistol 20, upper inclined contact surface 56 on upper front portion 55 of the magazine contacts contact surface 103 of sensing protrusion 112 on magazine disconnect plate 100, thereby axially sliding the plate horizontally forward to and holding the plate in the unblocking position shown in FIG. 9 (as illustrated by the directional arrows). Spring 120 is in a fully compressed state when magazine disconnect plate 100 is in this unblocking position. When pulled, the trigger 40 is freely and fully rotatable through opening 101 in magazine disconnect plate 100 to cock and release the hammer 60 for discharging pistol 20 since blocking flange 102 is not vertically aligned with but instead horizontally offset forward of blocking ledge 130 as shown so that a trigger pull will not mutually engage blocking surfaces 115 and 131. The firing control mechanism is therefore fully enabled and operable to discharge pistol 20.

To remove magazine 50 from pistol 20, the user activates a conventional magazine release latch mechanism 53 (shown in FIG. 2) in typical fashion to drop the magazine. As magazine 50 begins to drop downwards, contact between upper front portion 55 and front facing inclined contact surface 56 of magazine 50 and rear facing contact surface 103 of magazine disconnect plate 100 is broken. Since magazine 50 is no longer positioned in magazine cavity 51 of pistol 20 to hold magazine disconnect plate 100 in the non-blocking position, fully compressed magazine disconnect spring 120 expands thereby urging and axially sliding magazine disconnect plate 100 fully rearwards to the blocking position shown in FIG. 10. The rear end 105 of magazine disconnect plate 100 enters the magazine opening 81 in firing control housing 80 (shown in FIG. 6) since magazine 50 is absent. Spring 120 is now in a fully expanded state. Blocking flange 102 on magazine disconnect plate 100 now axially moves horizontally into vertical alignment with blocking ledge 131 on trigger 40 to the blocking position of the plate shown in FIG. 10. If the user attempts to pull trigger 40 now with the magazine 50 removed from pistol 20, the upward facing blocking surface 115 on blocking flange 102 will engage downward facing blocking surface 131 on ledge 130 to restrict and prevent the trigger from fully rotating to cock and release hammer 60 (shown in FIGS. 1-4) necessary to discharge pistol 20. The firing control mechanism is therefore disabled so that if a round remains in the chamber, the pistol 20 will not fire without the magazine present.

When magazine 50 is reinserted back into pistol 20, the magazine will again contact magazine sensing protrusion 112 on magazine disconnect plate 100 in the same manner describe above, thereby axially sliding the plate back forward to the unblocking position shown in FIG. 9. Trigger 40 is thus fully rotatable via a trigger pull and pistol 20 is again in a ready-to-fire condition.

While the foregoing description and drawings represent preferred or exemplary embodiments of the present invention, it will be understood that various additions, modifications and substitutions may be made therein without departing from the spirit and scope and range of equivalents of the accompanying claims. In particular, it will be clear to those skilled in the art that the present invention may be embodied in other forms, structures, arrangements, proportions, sizes, and with other elements, materials, and components, without departing from the spirit or essential characteristics thereof. In addition, numerous variations in the methods/processes as applicable described herein may be made without departing from the spirit of the invention. One skilled in the art will further appreciate that the invention may be used with many modifications of structure, arrangement, proportions, sizes, materials, and components and otherwise, used in the practice of the invention, which are particularly adapted to specific environments and operative requirements without departing from the principles of the present invention. The presently disclosed embodiments are therefore to be considered in all respects as illustrative and not restrictive, the scope of the invention being defined by the appended claims and equivalents thereof, and not limited to the foregoing description or embodiments. Rather, the appended claims should be construed broadly, to include other variants and embodiments of the invention, which may be made by those skilled in the art without departing from the scope and range of equivalents of the invention.

What is claimed is:

1. An auto-loading firearm with magazine disconnect mechanism cornprising:

a frame defining a longitudinal axis;

a magazine removably disposed in the frame and adapted for holding a plurality of cartridges;

a hammer pivotably mounted in the frame;

a trigger pivotably movable in the frame via a transverse trigger pin and operable to cock and release the hammer for discharging the firearm;

a substantially planar magazine disconnect member mounted below the trigger pin and comprising a horizontally oriented plate having a flat longitudinally elongated body, a front end, a rear end, and central opening between the ends which receives at least part of the trigger therethrough, the plate selectively engageable with the trigger in response to removing and inserting the magazine, the magazine disconnect member movable between a blocking position in which the disconnect member engages the trigger when pulled and a non-blocking position in which the disconnect member does not engage the trigger when pulled; and a biasing member urging the magazine disconnect member into the blocking position, the biasing member acting directly on an upward extending sensing protrusion disposed on the rear end of the plate proximate to the magazine;

wherein inserting the magazine into the frame moves the magazine disconnect member from the blocking position to the non-blocking position; and wherein removing the magazine from the frame moves the disconnect member from the non-blocking position to the blocking position in which movement of the trigger is restricted to prevent cocking the hammer.

2. The firearm of claim 1, wherein the magazine disconnect member is slideably disposed in the frame for axial movement in a longitudinal direction between the blocking and non-blocking positions.

3. The firearm of claim 2, wherein a front portion of the trigger includes a blocking surface which is engageable with a corresponding blocking surface disposed on the magazine disconnect member forward of the trigger blocking surface.

4. The firearm of claim 1, wherein the magazine disconnect member includes an upward facing horizontal blocking surface that is moveable into and out of alignment with a corresponding downward facing horizontal blocking surface on the trigger.

5. The firearm of claim 4, wherein the blocking surface on the magazine disconnect member is disposed on an upward protruding blocking flange.

6. The firearm of claim 1, wherein the magazine disconnect member is slidably disposed in an elongate recess formed in the underside of the frame around the trigger.

7. The firearm of claim 6, wherein the magazine disconnect member and frame recess include mating complementary configured dovetailed sloping surfaces having greater than a zero degree slope that slidably retain the magazine disconnect member in the frame.

8. The firearm of claim 1. wherein a rear end of the magazine disconnect member includes a rearward angled sensing protrusion that is positioned in the frame to engage the magazine when inserted into the firearm and in response move the magazine disconnect member to the non-blocking position.

9. An auto-loading firearm with magazine disconnect mechanism comprising:

a frame defining a longitudinal axis;

a magazine removably disposed in the frame for holding a plurality of cartridges;

a hammer pivotably mounted in the frame;

a trigger pivotably movable in the frame via a transverse trigger pm and operable to cock and release the hammer for discharging the firearm, a front portion of the trigger defining a first blocking surface;

a substantially planar magazine disconnect member mounted below the trigger pin and defining a. second blocking surface which is selectively engageable with the first blocking surface of the trigger, the magazine disconnect member being longitudinally movable in response to removing and inserting the magazine between (i) a blocking position in which the second blocking surface is positioned to engage the first blocking surface of the trigger when pulled to prevent cocking the hammer and (ii) a non-blocking position in which the second blocking surface is positioned to not engage the first blocking surface of the trigger when pulled to cock the hammer;

the magazine disconnect member comprising a horizontally oriented plate having a fiat longitudinally elongated body, a front end, a rear end, and central opening between the ends which receives at least part of the trigger therethrough. the plate having a substantiall lanar horizontal to surface extending axially between the front and rear ends; and a biasing member urging the magazine disconnect member into the blocking position, the biasing member acting directly on an upward extending sensing protrusion disposed on the rear end of the plate proximate to the magazine;

wherein inserting the magazine into the frame moves the magazine disconnect member from the blocking position to the non-blocking position; and wherein removing the magazine from the frame moves the disconnect member from the non-blocking position to the blocking position to prevent discharging the firearm.

10. The firearm of claim 9, wherein the magazine disconnect member is slidably disposed in the frame for axial movement in a longitudinal direction between the blocking and non-blocking positions.

11. The firearm of claim 9, wherein the second blocking surface on the magazine disconnect member faces in an upward direction and the first blocking surfface on the trigger faces in a downward direction.

12. The firearm of claim 11, wherein the blocking surface on the magazine disconnect member is disposed on an upward protruding flange brined on the disconnect member.

13. The firearm of claim 9, wherein the second blocking surface on the :magazine disconnect member is horizontally moveable into and out of vertical alignment with corresponding first blocking surface on the trigger between the blocking and non-blocking positions of the magazine disconnect member, respectively.

14. An auto-loading firearm with magazine disconnect mechanism comprising:

a frame defining a longitudinal axis;

a magazine removably disposed in the frame for holding a plurality of cartridges;

a firing control mechanism including a trigger bar coupled to a trigger pivotably mounted in the frame via a transverse trigger pin, the trigger being operable via the trigger bar to discharge the firearm;

a substantially planar magazine disconnect plate mounted on an underside of the frame below the trigger pin and having a flat longitudinally elongated body, the plate slidably disposed in the frame for forward and rearward axial horizontal movement in response to removing and inserting the magazine, the magazine disconnect plate being selectively engageable with the trigger between a blocking position in which the disconnect plate engages the trigger when pulled and a non-blocking, position in which the disconnect plate does not engage the trigger when pulled;

the magazine disconnect plate further comprising a front end, a rear end, and central opening between the ends which receives at least part of the trigger therethrough, the plate having a thickness and substantially planar horizontal to surface extending axially between the front and rear ends, and a biasing member urging the magazine disconnect plate into the blocking position, the biasing member acting directly on an upward extending sensing protrusion disposed on the rear end of the plate proximate to the magazine, the sensing protrusion being formed on a reverse rolled portion of the plate having the same thickness as the plate;

wherein inserting the magazine into the frame moves the magazine disconnect plate from the blocking position to the non-blocking position; and wherein removing the magazine from the frame causes the spring to move the disconnect plate from the non-blocking position to the blocking position in which movement of the trigger is restricted to prevent discharging the firearm.

15. The firearm of claim 14, wherein a front portion of the trigger includes a first horizontal blocking surface which is engageable with a second horizontal blocking surface on the magazine disconnect plate in the blocking position.

16. The firearm of claim 15, wherein the second blocking surface on the magazine disconnect plate is disposed on top of an upward protruding flange formed on the disconnect plate.

17. The firearm of claim 15, wherein the second blocking surface on the magazine disconnect plate is horizontally moveable into and out of vertical alignment with corresponding, first blocking surface on the trigger between the blocking and non-blocking positions of the magazine disconnect member, respectively.

18. A method for blocking the discharge of a firearm comprising providing a firearm having a frame including a removable magazine for holding a plurality of cartridges and a trigger pivotably moveable via a transverse trigger pin for discharging the firearm;

providing a magazine disconnect member mounted below the trigger pin and comprising a substantially planar plate having a flat longitudinally elongated body, a front end, a rear end, and central opening between the ends which receives at least part of the trigger therethrough, the plate having a substantially planar horizontal top surface extending axially between the front and rear ends;

biasing the magazine disconnect member in a first direction by engaging a spring directly an upward extending sensing protrusion disposed on the rear end of the plate proximate to the magazine:

removing the magazine from the firearm;

axially sliding the spring-biased, magazine disconnect member in the first direction into engagement with the trigger in response to removing the magazine wherein movement of the trigger is restricted to prevent discharging the firearm.

19. The method of claim 18, further comprising:

reinserting the magazine into the firearm; and axially sliding the magazine disconnect member in a second direction opposite the first direction out of engagement with the trigger in response to reinserting the magazine wherein movement of the trigger is unrestricted to allow discharging the firearm.

20. The method of claim 19, wherein the first direction is rearward and the second direction is forward.

21. The method of claim 18, further comprising a step of vertically aligning a blocking surface on the trigger with a blocking surface on the magazine disconnect member during the step of axially sliding the magazine disconnect member in the first direction.

* * * * *

UNITED STATES PATENT AND TRADEMARK OFFICE

CERTIFICATE OF CORRECTION

PATENT NO. : 8,438,768 B2
APPLICATION NO. : 12/986272
DATED : May 14, 2013
INVENTOR(S) : Robert A. Kallio It is certified that error appears in the above-identified patent and that said Letters Patent is hereby corrected as shown below:

In the Claims

Column 12, line 46, Claim 1, the text "cornprising" should be changed to --comprising--
Column 13, line 36, Claim 8, the punctuation "." should be changed to --,--
Column 13, line 48, Claim 9, the text "pm" should be changed to --pin--
Column 13, line 52, Claim 9, the punctuation "." should be deleted
Column 13, line 65, Claim 9, the text "fiat" should be changed to --flat--
Column 14, line 1, Claim 9, the punctuation "." should be changed to --,--
Column 14, line 1, Claim 9, the text "substantiall lanar" should be changed to --substantially planar--
Column 14, line 2, Claim 9, the text "to" should be changed to --top--
Column 14, line 21, Claim 11, the text "surfface" should be changed to --surface--
Column 14, line 25, Claim 12, the text "brined" should be changed to --formed--
Column 14, line 27, Claim 13, the punctuation ":" should be deleted
Column 14, line 49, Claim 14, the punctuation "," should be deleted
Column 14, line 56, Claim 14, the text "to" should be changed to --top--
Column 15, line 16, Claim 17, the punctuation "," should be deleted
Column 15, lines 19-20, Claim 18, after the text "a firearm comprising" insert the punctuation --:--
Column 16, line 5, Claim 18, after the text "a spring directly" insert --with--
Column 16, line 9, Claim 18, delete the punctuation ","

Signed and Sealed this
First Day of April, 2014

Michelle K. Lee

Michelle K. Lee
*Deputy Director of the United States Patent and Trademark Office*